United States Patent [19]

Streble

[11] 4,188,080

[45] Feb. 12, 1980

[54] CABLE FOR TRANSMITTING LOW-LEVEL SIGNALS

[75] Inventor: Bernd Streble, Friedberg, Fed. Rep. of Germany

[73] Assignee: Siemens Aktiengesellschaft, Berlin & Munich, Fed. Rep. of Germany

[21] Appl. No.: 882,855

[22] Filed: Mar. 2, 1978

[30] Foreign Application Priority Data

Mar. 16, 1977 [DE] Fed. Rep. of Germany ..... 2711531

[51] Int. Cl.[2] ..... H01B 11/04

[52] U.S. Cl. ..... 339/14 R; 174/32; 174/115; 179/78 R

[58] Field of Search ..... 174/27, 32, 34, 115; 339/14 P, 14 R, 143 R, 117 R, 113 R; 179/78 R

[56] References Cited

U.S. PATENT DOCUMENTS

| | | | |
|---|---|---|---|
| 3,237,146 | 2/1966 | Barker | 339/143 R |
| 3,569,900 | 3/1971 | Uberbacker | 339/14 R |

FOREIGN PATENT DOCUMENTS

| | | | |
|---|---|---|---|
| 245122 | 5/1960 | Australia | 174/34 |
| 205314 | 9/1939 | Switzerland | 174/32 |
| 971714 | 8/1964 | United Kingdom | 174/27 |
| 1059343 | 2/1967 | United Kingdom | 174/34 |

*Primary Examiner*—Bruce A. Reynolds
*Assistant Examiner*—E. Frederick Borchelt
*Attorney, Agent, or Firm*—Hill, Van Santen, Steadman, Chiara & Simpson

[57] ABSTRACT

A cable for low-level signal transmission which exhibits reduced cross-talk interference. The cable consists of a four-conductor spiral quad of two opposed insulated signal wires and two non-insulated ground wires. Each of the wires may be stranded.

7 Claims, 2 Drawing Figures

CABLE FOR TRANSMITTING LOW-LEVEL SIGNALS

BACKGROUND OF THE INVENTION

This invention relates to signal transmitting cables and more particularly to a cable for transmitting low-level signals having a reduced cross-talk interference.

Prior Art

Modern technology requires multiple electrical interconnections for numerous purposes including low-level signals. However, although such signals are particularly sensitive to interference, the high packing density which is currently attained in some electrical systems, particularly in connection with components on circuit boards, has led to the requirement that the conductors employed to supply both ground lines and signal lines within such components must also exhibit a high packing density. This requirement can be particularly important when the lines are used to transmit digital data signals. In such instances the transmission quality must be subject to relatively high criteria for obvious reasons. Since transmission quality is reduced both by mismatching and, particularly, by too high a noise level or cross-talk from one signal wire to the other, increase in packing density can adversely effect transmission quality. Such cross-talk problems are particularly high at junction points such as, for example, plug-in connectors. However, modern circuit technology employs a large number of such plug-in connector units. Moreover, with the desired increase in density, such plug-in connector units have become quite small with a resulting decrease in physical space available for the individual transmitting lines.

In order to avoid disturbing influences such as cross-talk, it has been known to utilize a stranded pair of wires with the individual wires being coated with an extremely thin lacquer in an attempt to insulate them from one another. Thus, each line pair, consisting, for example, of a signal line and a ground line, will have the two lines or wires separately coated. If the insulation coating is carried out by means of an extrusion process or by a process in which the insulation is applied to the wire by stratification, it is not then, in practice, possible to meet an impedance requirement for a surge impedance of 50 ohms. Since lacquer insulation provides poor protection from damage, each individual conductor must additionally be surrounded by a protective casing. Moreover, when attaching the wires to units, such as plugs, if the crimp technique is employed, there is an increased danger of breakage since crimp joining processes cause great deformation of the wires.

Additionally, it has been known to use flat cables in which the signal lines may be positioned next to each other in parallel and may be separated by ground conductors. Due to an unfavorable junction from the flat line to the plug, a relatively high degree of cross-talk occurs with such a flat cable. Moreover, because solid conductors are used, the impression of a thin individual conductor wire into a connection element by crimping has the same disadvantages as discussed above in connection with stranded wire pairs.

Although cross-talk can be substantially eliminated by using coaxial lines, the use of such lines is not economical both due to a high production cost and due to expensive and time consuming connection procedures.

It would therefore be an advance in the art to provide a relatively inexpensive low signal level conductor which exhibits greatly reduced cross-talk interference problems while avoiding the prior crimping problems and which is easily plug connectable.

SUMMARY OF THE INVENTION

It is therefore a primary object of this invention to provide cables for low-level signal transmission and in particular for digital data signals, where the cables are adequately resistant to interference radiation while exhibiting a low cross-talk from one line to another. Particularly, it is an object of this invention to meet the above objective while providing an economically produced and processed cable which has good mechanical properties. Moreover, the cable is desired to be one which facilitates a connection technique which maintains so called "close cross-talk" as low as possible.

The above objects are met according to this invention in that two conductors are positioned opposite to one another and are designated as signal conductors and two other conductors are designated as ground conductors. The ground conductors are not insulated while the signal conductors are each individually insulated. The conductors are formed of a plurality of individual wires and the four conductors are arranged as a four-wire spiral quad.

In a particularly advantageous embodiment of the invention, the cores of the four conductors each have the same diameter and the insulation is dimensioned such that a surge impedance of 50 ohms exists between the individually insulated signal conductors and the non-insulated ground conductors.

This invention provides for the production of cables which exhibit the desired low degree of cross-talk while maintaining the cable production both simple and economical. The cables can lead directly to a plug connector while in the stranded spiral quad state thereby resulting in an optimum resistance to interference radiation while maintaining low close cross-talk features.

Due to the fact that the two ground conductors are positioned adjacent and enclosed between the two signal conductors, the electric field is concentrated in the vicinity of the ground conductors and the mutual influence of the signal conductors upon each other is reduced to a minimum.

Moreover, by using stranded wire for the individual conductors in place of a solid conductor it is possible to use the crimp connnection technique while avoiding breakage. That is, the conductor can be attached to a connection element by enclampment without soldering, while because of the use of stranded wire, the forces generated during clamping will not cause a breakage of the wire. Additionally, the use of stranded wire provides the known advantage of a high alternating bending strength.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENT

Figure 1:
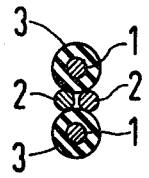
FIG. 1 is a schematic illustration of a cable according to this invention.

A cable according to this invention is shown in section in FIG. 1. The cable is formed as a four-conductor "spiral quad" or "stranded quad". Thus, the cable provides two signal conductor wires 1 which are positioned opposite one another and which enclose two ground conductors 2. The conductors 1 are insulated and the ground conductors 2 are bare. Because of the insulation on the signal conductors 1, they are spaced further apart from one another than are the ground conductors 2 and the ground conductors 2 are therefore positioned somewhat intermediate the signal conductors. The signal conductors 1 are preferrably formed with a synthetic insulation 3 which consists of a layer, which may be applied by an extrusion process, of approximately 100 $\mu$m.

Preferrably the core of each of the conductors 1 and 2 comprises nine stranded individual wires having a diameter of approximately 0.3 mm. Dimensioning of this type produces a surge impedance of 50 ohms between each individual insulated signal conductor 1 and the ground conductors 2. Of course, as will be apparent to those skilled in the art, different variations of this dimensioning are also possible.

Figure 2:
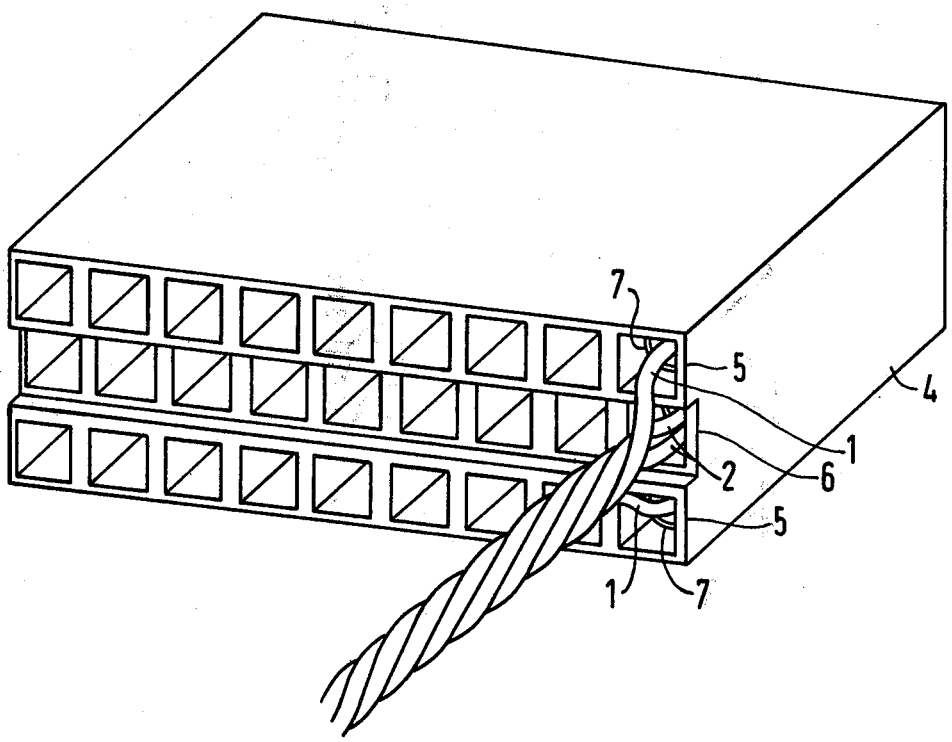
FIG. 2 is a perspective view of a juncture of a cable according to this invention with a three-row plug connector.

The use of ground conductors 2 and the resultant high concentration of the electric field in their vicinity renders the overall cable particularly resistant to interference radiation. Moreover, as illustrated in FIG. 2, the overall cable can be led directly to a plug connector such as the plug connector 4 designed as a three-row line plug. The direct connection of the cable to the connector considerably reduces the "close cross-talk" which actually occurs adjacent the plug.

In the three-row line plug 4 illustrated in FIG. 2, the plug is comprised of two spaced apart signal line rows 5 and an intermediate ground row 6. The signal conductors 1 and the ground conductors 2 of the cable can therefore be directly connected to the plug connection element 7 by a crimping process. A process such as that set forth in DIN 41611 can be used. Because of the particular construction of the preferred cable, it is not possible for the individual wires to break during this attachment process.

Due to the cables' resistance to interference radiation, particularly when compared to a flat cable, it is possible to combine a plurality of cables to form one common line connection and to enclose these in a common protective casing when desired. Thus, for example, all of the stranded quad cables attached to a common plug can be brought together and encased in a single overall casing without destruction of the low-level signal transmission capability caused by interference radiation.

Although the teachings of my invention have herein been discussed with reference to specific theories and embodiments, it is to be understood that these are by way of illustration only and that others may wish to utilize my invention in different designs or applications.

I claim as my invention:

1. A signal transmitting system for transmitting two signals by cable with reduced cross-talk wherein the cable comprises:

a cable formed of four conductors arranged together in a spiral quad, two of said conductors being positioned opposite to one another, said two of said conductors being signal conductors, the other two of said conductors being ground conductors, wherein the ground conductors are bare and the signal conductors are individually insulated and wherein the winding of the spiral quad is such that a line joining the center of the cores of the signal conductors is substantially perpendicular to the line joining the centers of the cores of the ground conductors, and wherein one of said signals is transmitted by one of said signal conductors and the other of said signals is transmitted by the other of said signal conductors.

2. A signal transmitting system according to claim 1 wherein the conductors are each formed of a plurality of individual wires.

3. A signal transmitting system according to claim 2 wherein the conductors each have a core, and the cores each of the conductors are of substantially identical diameter, the insulation of the signal wires being dimensioned to provide a surge impedance of 50 ohms between the individual signal conductors and the non-insulated ground conductors.

4. A signal transmitting system according to claim 3 wherein the signal conductors are insulated by an extrusion process.

5. A signal transmitting system according to claim 1 wherein the ground conductors are positioned at least partially intermediate the signal conductors and are positioned closer adjacent one another than are the signal 6. A cable and connector assembly for transmitting low-level signals with a low degree of close cross-talk comprising a cable consisting of four conductors combined together to form a spiral quad, two of the conductors being positioned opposite one another and being designated as signal conductors, another two of said conductors being designated as ground conductors and being, at least in part, positioned intermediate the signal conductors, the signal conductors being individually insulated and the ground conductors being bare, the conductors being connected to a connection element, the connection element comprising a three-row plug, a central row of the plug forming a ground row, the ground connectors being attached to the ground row, outer rows of the plug forming signal rows, and one of the signal conductors being each attached to one of the signal rows.

7. The assembly of claim 6 wherein each of the conductors is formed of a plurality of wires, each of the conductors having a core, the cores being substantially identical sized, the insulation of the signal conductors being dimensioned to provide a surge impedance of approximately 50 ohms between the individual signal conductors and the ground conductors.

* * * * *